United States Patent [19]

Rubey

[11] 4,219,708

[45] Aug. 26, 1980

[54] SHOCKSWITCH

[75] Inventor: Ulyss R. Rubey, Lewisville, Tex.

[73] Assignee: Detectors, Inc., Graham, Tex.

[21] Appl. No.: 11,125

[22] Filed: Feb. 12, 1979

[51] Int. Cl.[2] ..... H01H 35/14

[52] U.S. Cl. ..... 200/61.47; 200/220

[58] Field of Search ..... 116/203; 340/669, 52 H; 200/61.47

[56] References Cited

U.S. PATENT DOCUMENTS

| | | | |
|---|---|---|---|
| 2,679,819 | 6/1954 | Torcheux | 116/203 |
| 3,623,449 | 11/1971 | Knutson | 116/203 |
| 3,739,191 | 6/1973 | Nagazumi et al. | 340/669 X |
| 3,846,748 | 11/1974 | Hopwood | 200/61.47 X |
| 3,869,588 | 3/1975 | Ubukata et al. | 200/61.47 |
| 4,068,613 | 1/1978 | Rubey | 116/203 |
| 4,138,600 | 2/1979 | Ozols | 200/61.47 |

*Primary Examiner*—Daniel M. Yasich

*Attorney, Agent, or Firm*—Wofford, Fails & Zobal

[57] ABSTRACT

An improved apparatus for indicating that an acceleration greater than a predetermined acceleration has occured; the apparatus being of the type having a liquid reservoir and an adjacent gas region; the liquid-gas surface resisting deformation due to surface tension. The liquid, gas and surrounding structure are chosen such that the surface tension prevents a rupture of the liquid-gas barrier until an acceleration greater than a predetermined acceleration occurs; at which time at least a portion of the liquid enters the region of the gas. Electrical contacts within the gas region are bridged by the liquid, which liquid is electrically conducting. Means are provided to conduct electricity to and from the contacts such that communication of the forming of the bridge is possible.

2 Claims, 2 Drawing Figures

SHOCKSWITCH

BACKGROUND OF THE INVENTION

1. Field of the Invention

This invention relates to apparatus for detecting shock and more particularly to apparatus for indicating whether a shock of a predetermined magnitude has occurred.

2. Description of the Prior Art

Prior to this invention, there were a wide variety of electronic, mechanical, and electromechanical apparatus to measure shock or acceleration. Most of these devices are large and complex and provide a constant output showing the present value of acceleration. There is a need, however, for small simple devices which can indicate merely whether a shock greater than a particular value has ever occurred. Such devices are useful when used with mechanical or electronic instruments that can be damaged if such a shock is encountered. It is often not possible with these instruments to otherwise determine if the damage has taken place.

One such simple acceleration detector is shown in my U.S. Pat. No. 4,068,613. This patent provides a hollow tube containing a reservoir of liquid and an adjoining plug of gas. If a large enough acceleration occurs, the liquid-gas interfacial barrier is broken which provides visual indication that the acceleration has occurred. However, the only indication that the shock has occurred is a visual one.

SUMMARY OF THE INVENTION

It is accordingly an object of the present invention to provide an improved apparatus for indicating the receipt of a predetermined shock; the improved apparatus giving an indication which can be electrically detected.

In accordance with the present invention, there is provided an apparatus for indicating that an acceleration greater than a predetermined acceleration has occurred; the apparatus being of the type wherein a deformable reservoir of an electrically conductive liquid is contained adjacent a non-conductive fluid in a suitable way such that the surface tension of the liquid prevents the liquid from entering the area occupied by non-conductive fluid until an acceleration larger than a predetermined acceleration causes a rupture of the interfacial barrier defined between the conductive liquid and the non-conductive fluid. An electrical circuit is activated into the "on" mode if the acceleration is received. Any arrangement of completing or breaking electrical continuity can be employed. A simple embodiment comprises a pair of electrical contacts located in a gas plug in a cylindrical bore having a liquid droplet thereacross such that the contacts are electrically bridged by the liquid when the above mentioned rupture occurs. Means are provided for electrically communicating that the bridge has been formed.

For a further understanding of the invention and further objects, features, and advantages thereof, reference may now be had to the following description taken in conjunction with the accompanying drawings.

DESCRIPTION OF THE PREFERRED EMBODIMENT

Figures 1, 2:
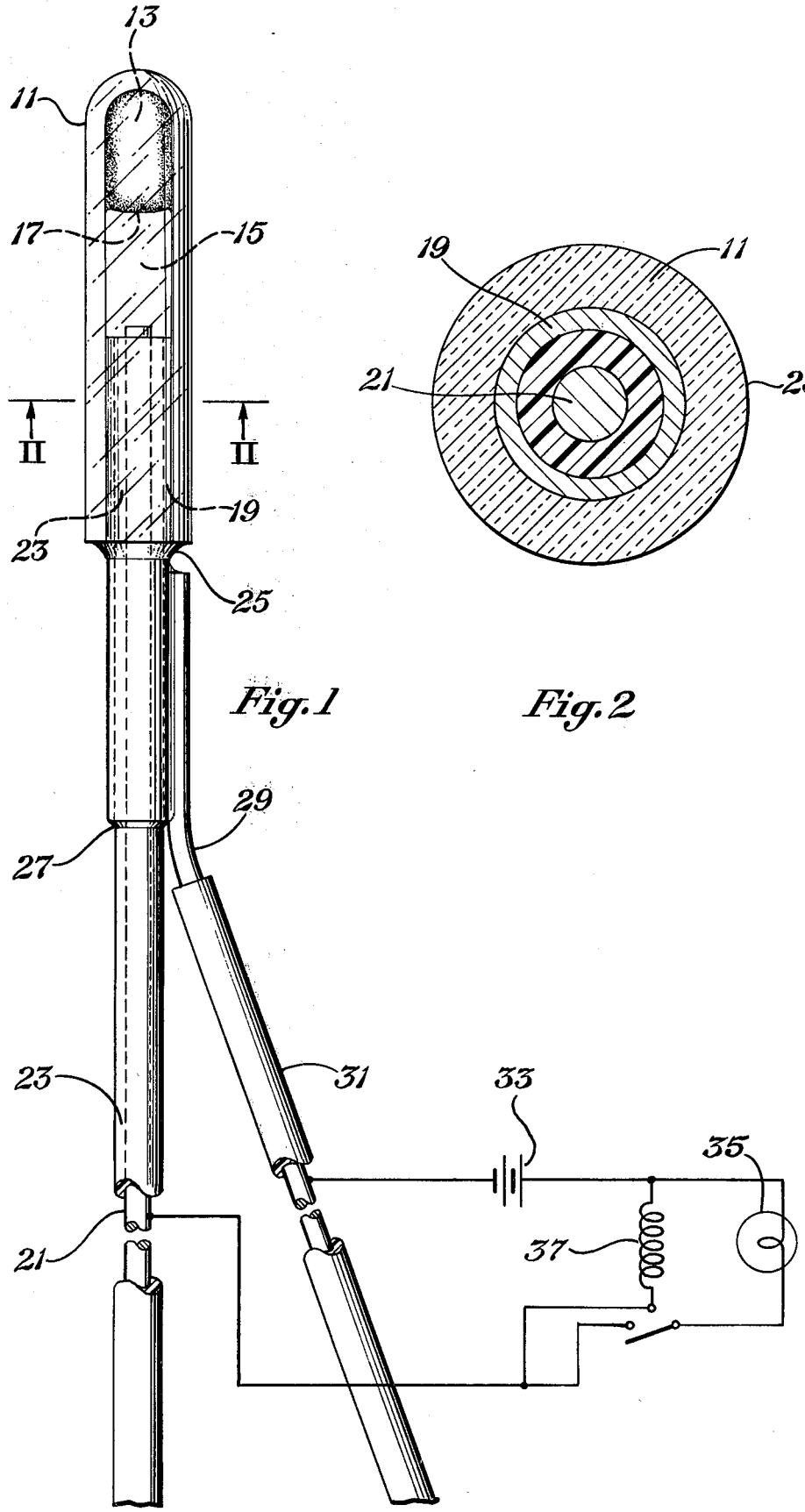
FIG. 1 is a side view of the present invention.
FIG. 2 is an enlarged section view taken along the line II—II, FIG. 1.

It should be borne in mind that this invention may be practiced by several embodiments, but only one will be described in detail. For example, it is immaterial whether an electrical circuit be completed or broken to establish an "on" mode, indicating that at least the predetermined acceleration has been received. Moreover, a variety of methods of holding a deformable reservoir of conductive liquid adjacent a non-conductive fluid, such as a gas, can be employed. Thus, specific embodiments could comprise the contacts of an electrical circuit being in the liquid reservoir so as to break the electrical continuity if the predetermined shock effected rupture of the interfacial barrier; or the contacts being in the gas phase such that the rupture and conductive liquid being moved between the contacts would complete the electrical circuit. Also specifically, the conductive liquid reservoir can be held between or within discontinuous coils or other configuration such that rupture of the interfacial barrier will render the circuit discontinuous. The simplest and preferred embodiment, however, is illustrated and described hereinafter.

Referring to FIG. 1, a glass tube 11 containing a reservoir of liquid 13 and a plug of gas 15 are shown in a side view. The gas and liquid meet defining an interfacial barrier 17. Due to surface tension, the interfacial barrier 17 resists deformation such that liquid 13 does not enter the area occupied by gas 15. However, if an acceleration greater than a predetermined acceleration occurs then interfacial barrier 17 is ruptured and the liquid moves into the area occupied by gas 15. The principles of this rupture and liquid movement are described in more detail in U.S. Pat. No. 4,068,613; the descriptive matter of which is hereby incorporated by reference for details omitted herein.

Disposed at the end of the gas plug opposite the reservoir of liquid 13, is a metal, annular tube 19 and a metal wire 21 separated by an insulator 23. A cross-section of glass tube 11 metal tube 19, wire 21, and insulator 23 is shown in FIG. 2. Metal tube 19 fits snuggly within glass tube 11 and is sealed thereto by a ring of epoxy resin 25. Wire 21 and insulator 23 fit snuggly within metal tube 19 to completely seal the end of glass tube 11. A ring of glue 27 holds insulator 23 to tube 19. A second wire 29 is soldered to metal tube 19 at a location outside of glass tube 11. Wire 29 is covered by insulation 31 except at the point of soldering. Thus, it can be seen that two separate and insulated electrical pathways are provided into the area of gas plug 15. These pathways are electrically bridged only when liquid 13 moves into the gas region because of a rupture of interfacial barrier 17.

As indicated hereinbefore, the detector, per se, can be employed in almost any conventional circuit to afford a remote indication of receipt of the predetermined physical shock, or acceleration. As shown schematically, in FIG. 1, the wires 29 and 21 are attached to a voltage source 33 and a communication device such as a bell or light 35 in order to warn an observer of the occurrence of physical shocks, or accelerations, greater than the predetermined accelerations. Specifically, the relay 37 is energized when the interfacial barrier 17 is ruptured and the liquid bridges the two contacts, wire 21 and metal tube 19.

In order to electrically bridge the two contact areas provided by tube 19 and wire 21, the liquid 13 must be an electrical conductor. In addition, the liquid must have a suitable surface tension in order to resist rupture of the interfacial barrier 17 prior to receiving an acceleration greater than the predetermined acceleration. Any of the conductive liquids; such as, those described in U.S. Pat. No. 4,068,613; can be employed. For example, aqueous solutions of inorganic salts can be employed. Mercury has been employed satisfactorily in operating devices, both for its surface tension and conductivity. An aqueous solution of 30% ethylene glycol has been found satisfactory for surface tension; and has adequate conductivity, particularly with ionic additives, such as NaCl or LiCl, for most purposes. This solution has the further advantage of a relatively low freezing point since ethylene glycol is an antifreeze.

In operation, glass tube 11 is attached to a location where shocks are to be monitored. The voltage source 33 and communication device 35 (i.e. lights or bells) can be remotely located if necessary, since the lengths of wires 29 and 21 are adjustable. Until a shock greater than the predetermined acceleration occurs, the reservoir of liquid 13 cannot come into contact with metal tube 19 or wire 21. However, when an acceleration greater than the predetermined acceleration occurs, then at least a portion of the liquid 13 escapes from the erservoir and electrically bridges the gap between metal tube 19 and wire 21. This closes the circuit and the communication device 35 is activated.

The foregoing disclosure and the showings made in the drawings are merely illustrative of the principles of this invention and are not to be interpreted in a limiting sense.

What is claimed is:

1. Apparatus for completing an electrical circuit and thereby indicating that an acceleration greater than a predetermined acceleration has occurred, consisting of:

a. a housing having therewithin an eleongate bore of substantially the same dimensions from a first end containing a reservoir of liquid to a second end containing electrical contacts;

b. a body of gas contained in said bore adjacent said second end;

c. a deformable reservoir of an electrically conductive liquid contained in said first end of said bore in the form of a droplet that extends laterally across said bore and adjacent said body of gas so as to define an interfacial barrier therebetween; the interfacial tension and the interfacial barrier being defined such that an acceleration greater than the predetermined acceleration effects rupture of the interfacial barrier such that at least a portion of the liquid escapes from the reservoir;

d. said electrical contacts including first and second electrical contacts disposed within said gas in said bore and closely adjacent each other with a gap therebetween such that no electrical circuit is possible therethrough until said liquid bridges said gap; said first and second contacts being disposed both in said second end in said bore such that when said at least a portion of the liquid escapes from the reservoir, an electrically conducting bridge is formed by the liquid between the first and second contacts; and e. means for conducting electricity to the first contact from the second contact for electrically communicating that the bridge has been formed and that said predetermined acceleration has been received; said contacts comprising a metallic wire centrally disposed in a metallic tube; said metallic tube being disposed about and electrically insulated laterally from said wire; and wherein said liquid comprises mercury that wets said metal wire and said metal tube such that once said acceleration has occurred and established said conductive bridge of said mercury between said contacts, a greater negative acceleration is required to return said at least a portion of said liquid to its original position and said indication of said acceleration remains.

2. Apparatus for completing an electrical circuit and thereby indicating that an acceleration greater than a predetermined acceleration has occurred, consisting of:

a. a housing having therewithin an elongate bore of substantially the same dimensions from a first end containing a reservoir of liquid to a second end containing electrical contacts;

b. a body of gas contained in said bore adjacent said second end;

c. a deformable reservoir of an electrically conductive liquid contained in said first end of said bore in the form of a droplet that extends laterally across said bore and adjacent said body of gas so as to define an interfacial barrier therebetween; the interfacial tension and the interfacial barrier being defined such that an acceleration greater than the predetermined acceleration effects rupture of the interfacial barrier such that at least a portion of the liquid escapes from the reservoir;

d. said electrical contacts including first and second electrical contacts disposed within said gas in said bore and closely adjacent each other with a gap therebetween such that no electrical circuit is possible therethrough until said liquid bridges said gap; said first and second contacts being disposed both in said second end in said bore such that when said at least a portion of the liquid escapes from the reservoir, an electrically conducting bridge is formed by the liquid between the first and second contacts; and e. means for conducting electricity to the first contact from the second contact for electrically communicating that the bridge has been formed and that said predetermined acceleration has been received;

said contacts comprising a metallic wire centrally disposed in a metallic tube; said metallic tube being disposed about and electrically insulated laterally from said wire; the surface of the bore which contacts the reservoir of liquid being hydrophobic and the liquid comprising an electrically conductive aqueous solution containing an antifreeze; said liquid being adapted to wet said metal contacts; and said electrical contacts being metal that said liquid will wet; such that said liquid wets said metal contacts upon contact and forms said electrically conductive bridge and a greater negative acceleration is required to return said at least a portion of said liquid to its original position; whereby said indication of said acceleration remains.

* * * * *